US007726937B2

(12) United States Patent
Baumann et al.

(10) Patent No.: US 7,726,937 B2
(45) Date of Patent: Jun. 1, 2010

(54) TURBINE ENGINE COMPRESSOR VANES

(75) Inventors: P. William Baumann, Amesbury, MA (US); Om Parkash Sharma, South Windsor, CT (US); Charles R. LeJambre, New Britain, CT (US); Sanjay S. Hingorani, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 776 days.

(21) Appl. No.: 11/519,629

(22) Filed: Sep. 12, 2006

(65) Prior Publication Data

US 2008/0063520 A1 Mar. 13, 2008

(51) Int. Cl.
*F04D 29/54* (2006.01)

(52) U.S. Cl. ..... 415/191; 415/199.5; 415/208.4; 415/208.5; 415/211.2

(58) Field of Classification Search ..... 415/191, 415/199.5, 208.1, 208.2, 208.4, 208.5, 211.2
See application file for complete search history.

(56) References Cited

U.S. PATENT DOCUMENTS

| | | | | |
|---|---|---|---|---|
| 2,663,493 | A * | 12/1953 | Keast | 415/199.5 |
| 2,795,373 | A | 6/1957 | Hewson | |
| 4,012,172 | A * | 3/1977 | Schwaar et al. | 416/228 |
| 5,088,892 | A | 2/1992 | Weingold et al. | |
| 5,642,985 | A | 7/1997 | Spear et al. | |
| 5,947,683 | A * | 9/1999 | Kobayashi | 415/208.1 |
| 6,899,526 | B2 * | 5/2005 | Doloresco et al. | 416/238 |
| 2005/0152778 | A1 | 7/2005 | Lewis | |
| 2005/0232773 | A1 | 10/2005 | Suciu et al. | |
| 2005/0232774 | A1 | 10/2005 | Suciu et al. | |
| 2006/0099070 | A1 | 5/2006 | Suciu et al. | |

FOREIGN PATENT DOCUMENTS

EP 661413 A1 * 7/1995

* cited by examiner

*Primary Examiner*—Igor Kershteyn
(74) *Attorney, Agent, or Firm*—Bachman & LaPointe, P.C.

(57) ABSTRACT

A gas turbine engine rotor stack includes one or more longitudinally outwardly concave spacers. Outboard surfaces of the spacers may be in close facing proximity to inboard tips of vane airfoils. The airfoils have dihedral and sweep.

24 Claims, 10 Drawing Sheets

TURBINE ENGINE COMPRESSOR VANES

BACKGROUND OF THE INVENTION

The invention relates to gas turbine engines. More particularly, the invention relates to gas turbine engine compressor vanes.

A gas turbine engine typically includes one or more rotor stacks associated with one or more sections of the engine. A rotor stack may include several longitudinally spaced apart blade-carrying disks of successive stages of the section. A stator structure may include circumferential stages of vanes longitudinally interspersed with the rotor disks. The rotor disks are secured to each other against relative rotation and the rotor stack is secured against rotation relative to other components on its common spool (e.g., the low and high speed/pressure spools of the engine).

Numerous systems have been used to tie rotor disks together. In an exemplary center-tie system, the disks are held longitudinally spaced from each other by sleeve-like spacers. The spacers may be unitarily formed with one or both adjacent disks. However, some spacers are often separate from at least one of the adjacent pair of disks and may engage that disk via an interference fit and/or a keying arrangement. The interference fit or keying arrangement may require the maintenance of a longitudinal compressive force across the disk stack so as to maintain the engagement. The compressive force may be obtained by securing opposite ends of the stack to a central shaft passing within the stack. The stack may be mounted to the shaft with a longitudinal precompression force so that a tensile force of equal magnitude is transmitted through the portion of the shaft within the stack.

Alternate configurations involve the use of an array of circumferentially-spaced tie rods extending through web portions of the rotor disks to tie the disks together. In such systems, the associated spool may lack a shaft portion passing within the rotor. Rather, separate shaft segments may extend longitudinally outward from one or both ends of the rotor stack.

Desired improvements in efficiency and output have greatly driven developments in turbine engine configurations. Efficiency may include both performance efficiency and manufacturing efficiency.

Interstage sealing has been one area of traditional concern. Traditional sealing systems utilize abradable seal material carried on inboard vane platforms and interacting with knife edge runners on one or both of the adjacent blade platforms or on connecting structure.

U.S. patent application Ser. Nos. 10/825,255, 10/825,256, and 10/985,863 of Suciu and Norris (hereafter the Suciu et al. applications, disclosures of which are incorporated by reference herein as if set forth at length) disclose engines having one or more outwardly concave interdisk spacers. With the rotor rotating, a centrifugal action may maintain longitudinal rotor compression and engagement between a spacer and at least one of the adjacent disks. The '255 and '256 applications show knife edge sealing runners on the spacers whereas the '863 application shows inboard free tips on vane airfoils in close running proximity to the spacers.

SUMMARY OF THE INVENTION

One aspect of the invention involves a turbine engine having a rotor with a number of disks. Each disk extends radially from an inner aperture to an outer periphery. Each of a number of stages of blades is borne by an associated one of the disks. A number of spacers each extend between an adjacent pair of the disks. The engine includes a stator having a number of stages of vanes. The stages of vanes may include at least a first stage of vanes having inboard airfoil tips in facing proximity to an outer surface of the first spacer at the first portion thereof. The airfoils have dihedral and sweep.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
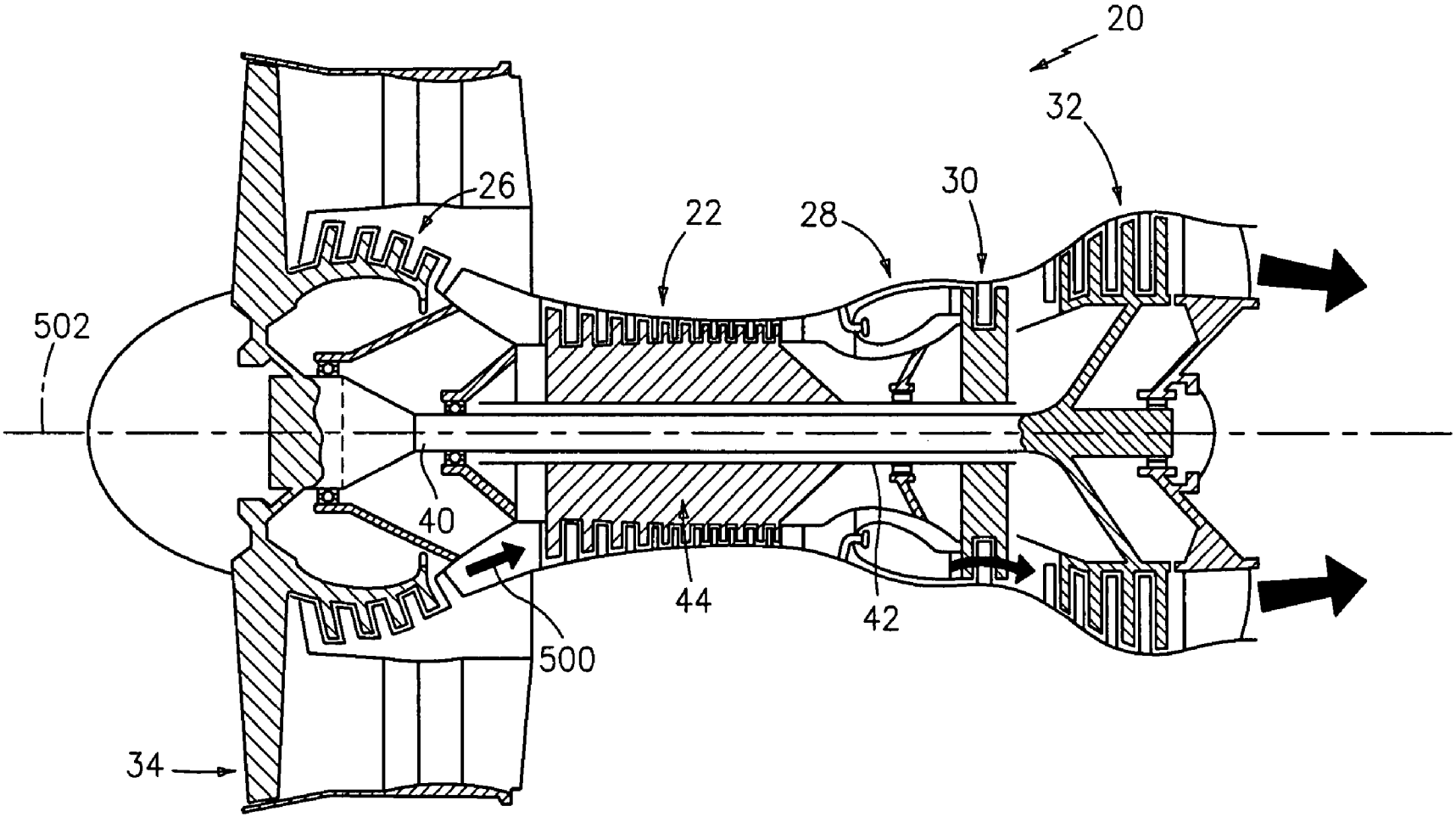
FIG. 1 is a partial longitudinal sectional view of a gas turbine engine.

FIG. 1 shows a gas turbine engine 20 having a high speed/pressure compressor (HPC) section 22 receiving air moving along a core flowpath 500 from a low speed/pressure compressor (LPC) section 26 and delivering the air to a combustor section 28. High and low speed/pressure turbine sections (HPT, LPT) 30 and 32 are downstream of the combustor along the core flowpath. The engine may further include a fan 34 (optionally transmission-driven) and an augmentor (not shown) among other systems or features.

The engine 20 includes low and high speed shafts 40 and 42 mounted for rotation about an engine central longitudinal axis or centerline 502 relative to an engine stationary structure via several bearing systems (not shown). Each shaft may be an assembly, either fully or partially integrated (e.g., via welding). The low speed shaft carries LPC and LPT rotors and their blades to form a low speed spool. The high speed shaft carries the HPC and HPT rotors and their blades to form a high speed spool.

Figure 2:
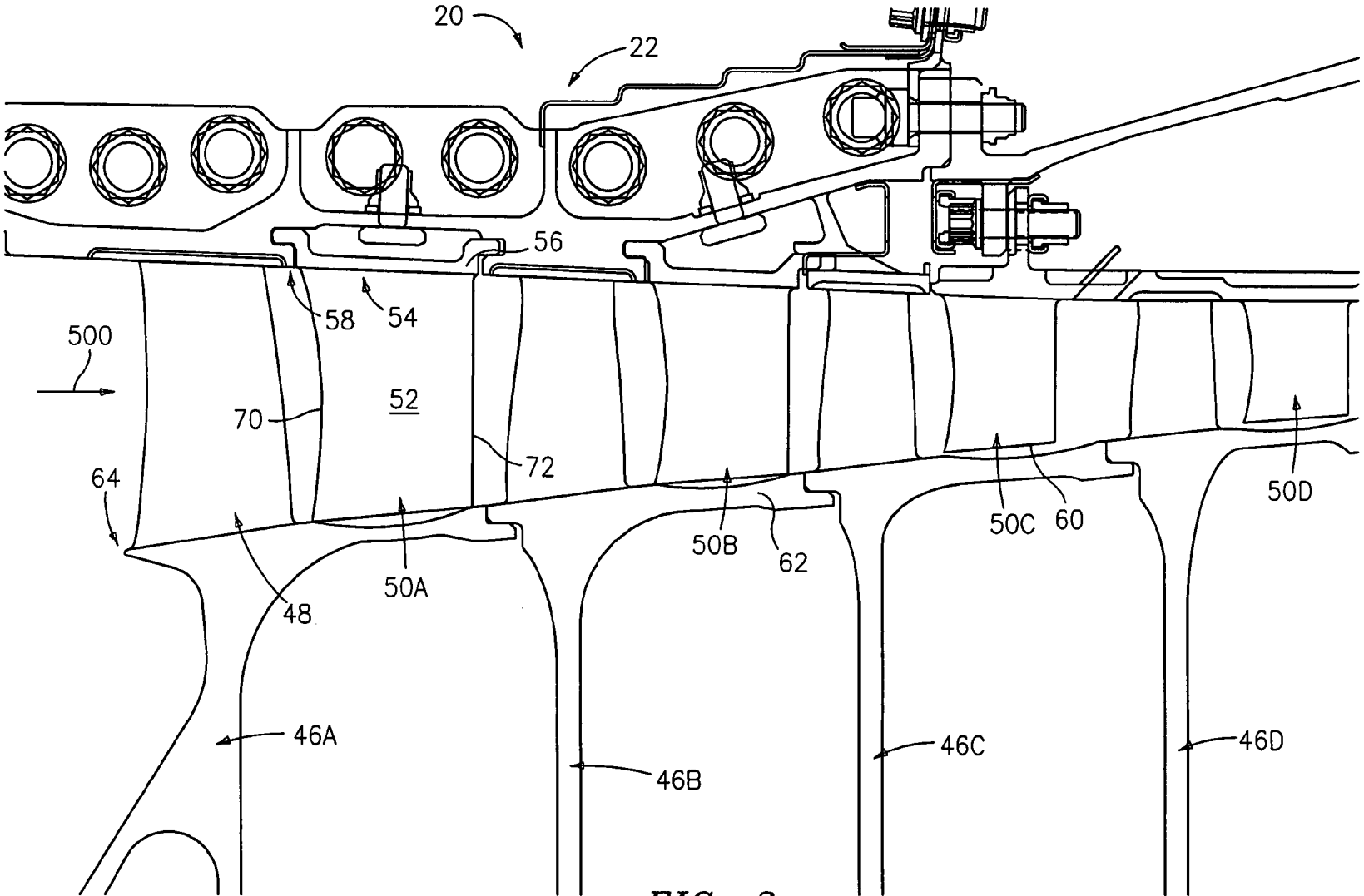
FIG. 2 is a partial longitudinal sectional view of a high pressure compressor of the engine of FIG. 1.

FIG. 1 shows an HPC rotor stack 44 mounted to the high speed shaft 28. The exemplary rotor stack 44 includes, from fore to aft and upstream to downstream, a plurality of blade disks 46A, 46B, 46C, and 46D (FIG. 2, further downstream stages not shown) each carrying an associated stage of blades 48. Between each pair of adjacent blade stages, an associated stage of vanes 50A, 50B, 50C, and 50D (downstream stages not shown) is located along the core flowpath 500. The vanes have airfoils 52 extending radially inward from roots 54 at outboard platforms 56 formed as portions of a core flowpath outer wall 58. The airfoils 52 extend to inboard airfoil tips 60 adjacent interdisk spacers 62 forming portions of a core flowpath inboard wall 64. Exemplary spacers may be as disclosed in the of the Suciu et al. '863 application. The exemplary spacers are of a generally concave-outward arcuate longitudinal cross-section in a static condition but may tend to straighten due to centrifugal loading.

The vane airfoils 52 extend from a leading edge 70 to a trailing edge 72. The apparent leading edge concavity of FIG. 2 reflects a bow and sweep profile/distribution discussed below. Swept blade airfoils are generally discussed in U.S. Pat. No. 5,642,985 of Spear et al. (the '985 patent). Blade airfoils are disclosed in U.S. Pat. No. 5,088,892 of Weingold et al. (the '892 patent). The disclosures of the '985 and '892 patents are incorporated by reference herein as if set forth at length.

Figure 3:
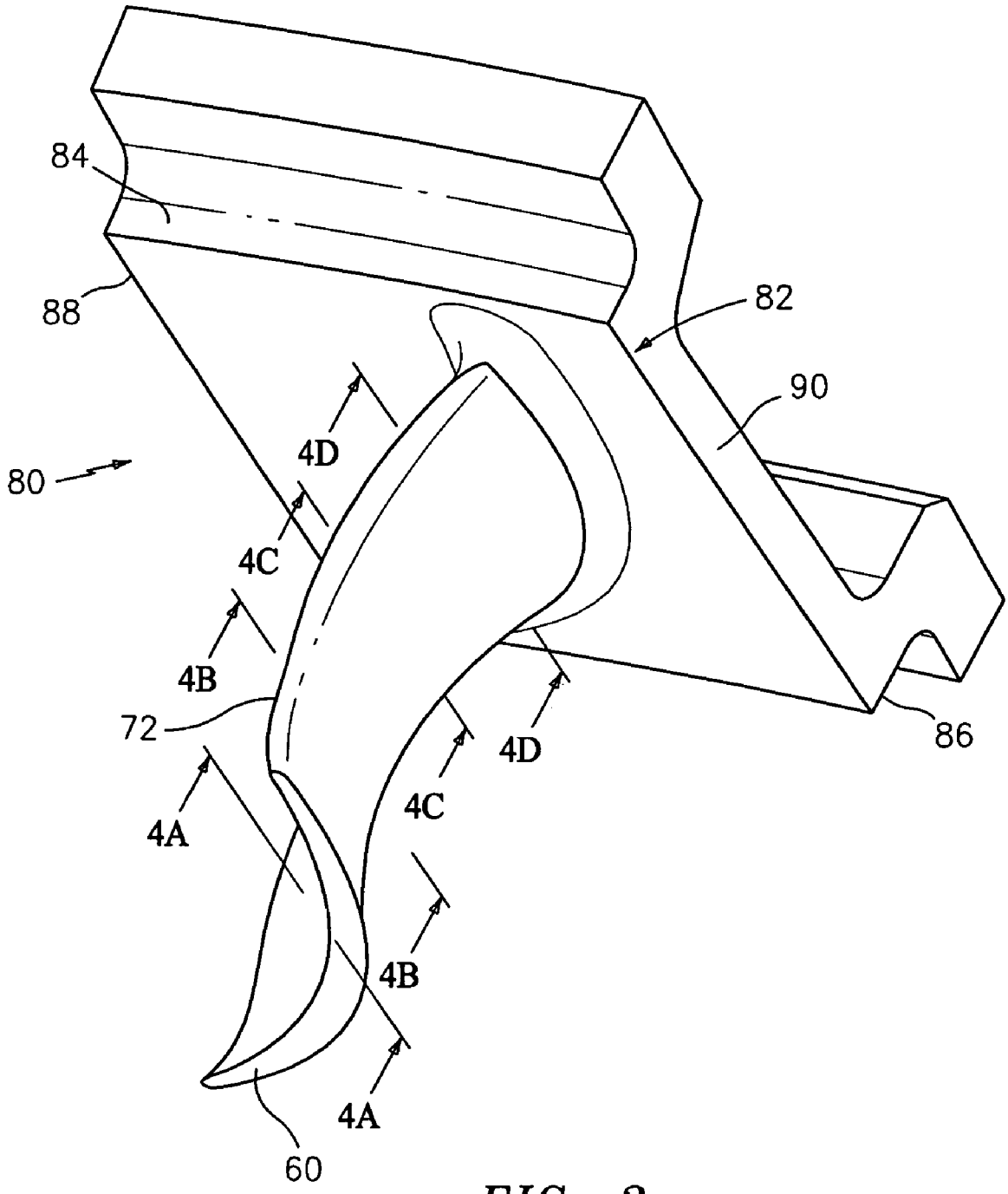
FIG. 3 is a view of a compressor vane of the engine of FIG. 1.
Figures 4A, 4B, 4C, 4D:
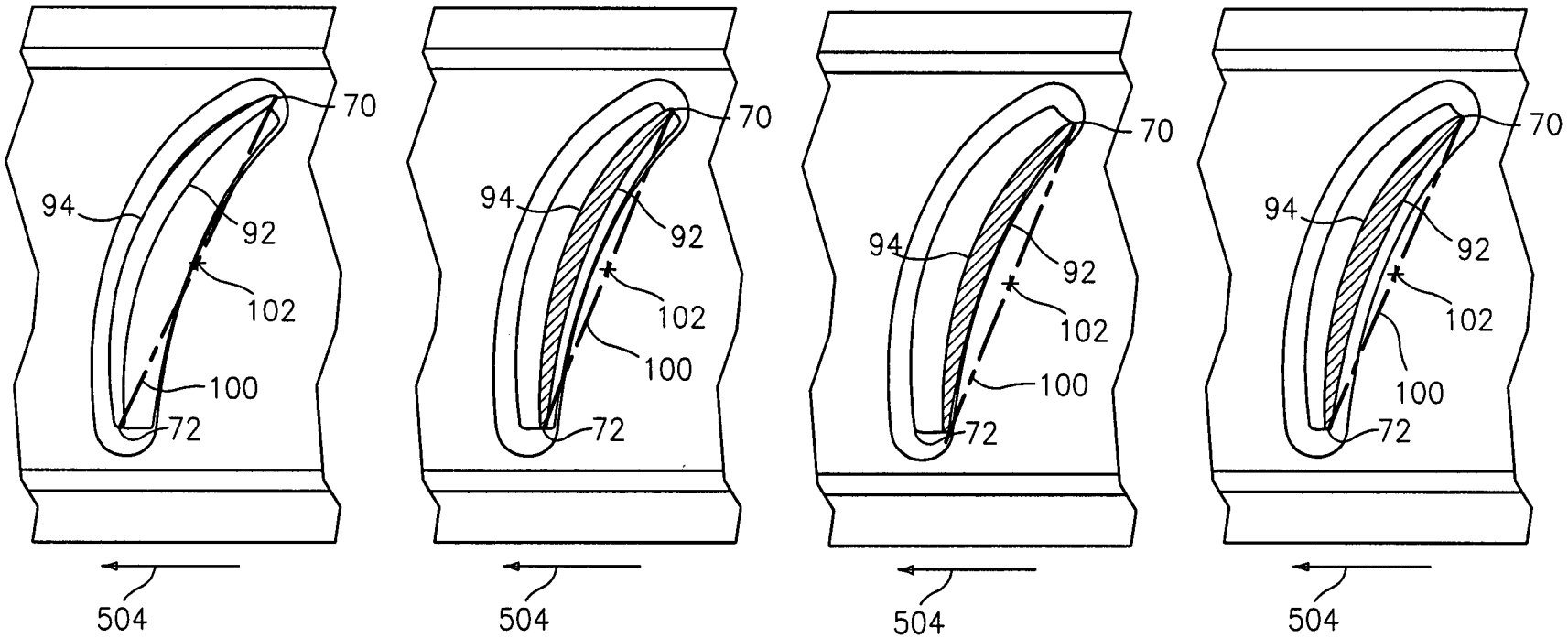
FIGS. 4A-4D are sectional views of the vane of FIG. 3.

FIG. 3 shows a vane-carrying shroud segment 280. The exemplary segment 280 includes an outboard shroud portion 282 extending between fore and aft longitudinal ends 284 and 286 and first and second longitudinally-extending circumferential ends 288 and 290. The longitudinal ends may bear engagement features (e.g., lips) for interfitting and sealing with adjacent case components. The circumferential ends may include features for sealing with adjacent ends of the adjacent shroud segments 280 of the subject stage (e.g., feather seal grooves). The exemplary shroud segment is a singlet, with a single vane airfoil 52 extending radially inward therefrom. The airfoil may be unitarily formed with the shroud such as by casting or may be integrated therewith such as by a stablug connection. Doublets and other multi-airfoil segments are possible as are continuous ring shrouds (such as unitarily cast members).

Figure 5:
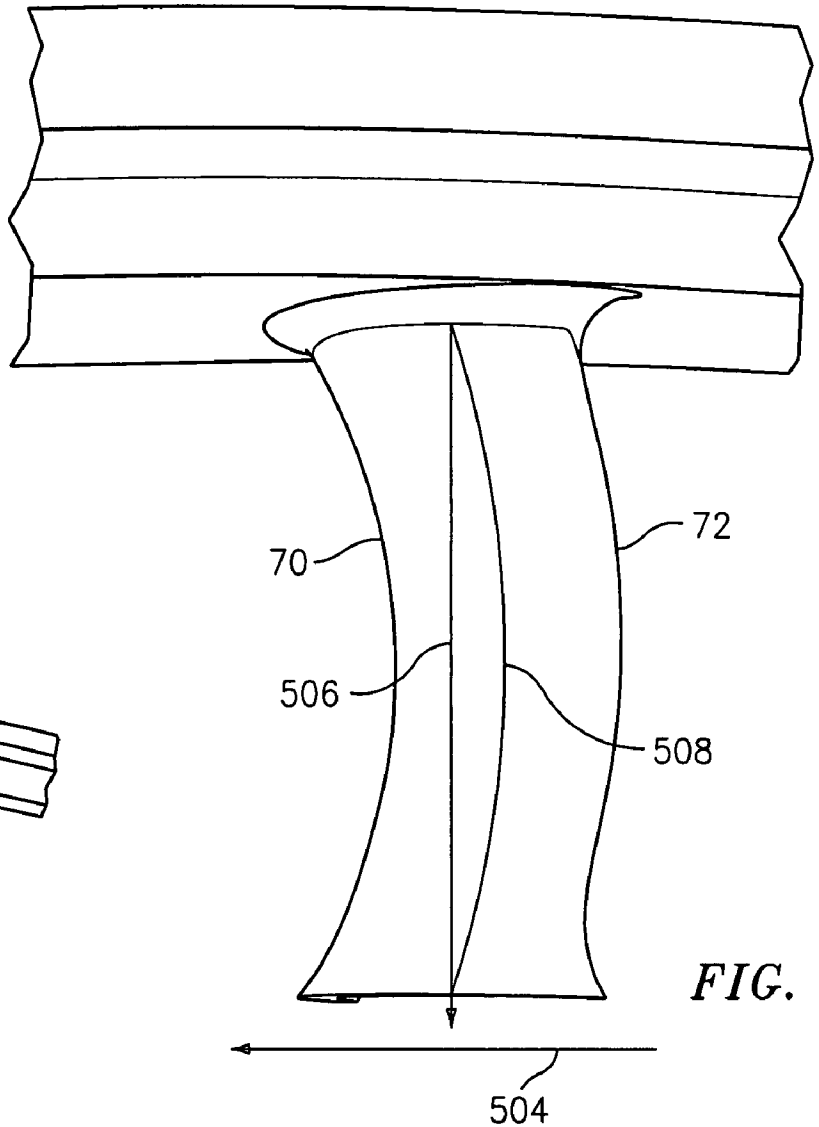
FIG. 5 is an aft view of the vane of FIG. 3.
Figure 6:
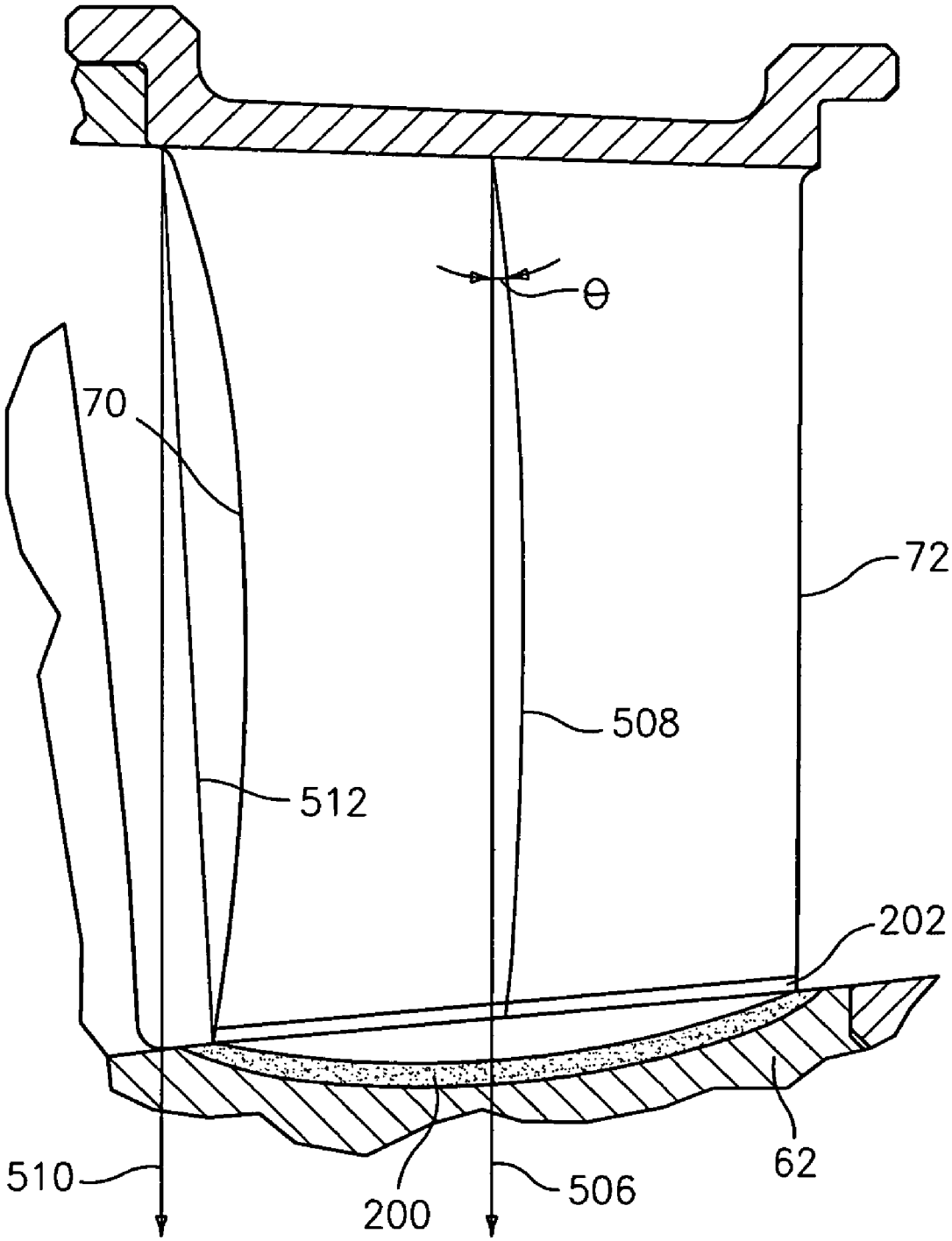
FIG. 6 is a side view of the vane of FIG. 3.

FIGS. 4A-4D show the pressure and suction sides 92 and 94 of the airfoil extending between the leading and trailing edges 70 and 72. FIGS. 4A-4D further show a direction of rotation 504 of the rotor relative to the stator. FIGS. 4A-4D also show a local chord line 100 having a centerpoint 102. FIGS. 5 and 6 also show a local radial line 506 intersecting the chord centerpoint 102 at the airfoil outboard root. FIGS. 5 and 6 also show a line 508 formed by the centerpoints 102 along the entire root-to-tip span of the airfoil. The line 508 is locally off-radial by an angle θ whose transverse and longitudinal projections are respectively marked at the root in FIGS. 5 and 6. FIG. 6 also shows a local radial line 510 intersecting the airfoil leading edge at the root and a line 512 intersecting the leading edge at the root and tip.

FIG. 6 further shows an abrasive coating layer 200 on the spacer 62 to preferentially wear by contact an abradable coating layer 202 on the stator airfoil tips. An exemplary layer 200 may be formed of cubic boron nitride (CBN) having a thickness of about 8 mil (0.2 mm). In broader exemplary thicknesses 0.1-0.3 mm. An exemplary layer 202 may be formed of zirconium oxide (ZrO) having a thickness of about 20 mil (0.5 mm). A broader exemplary thickness is 0.3-1.0 mm.

Figure 7:
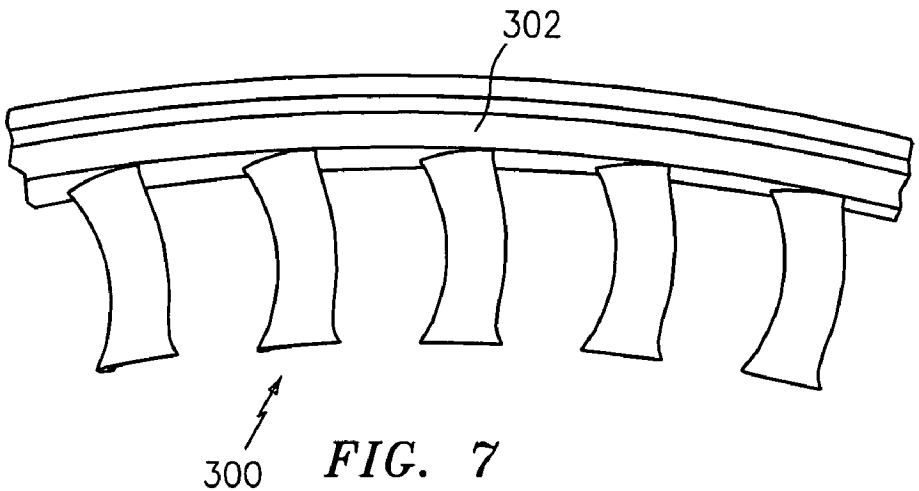
FIG. 7 is an aft partial view of a stator ring.

FIG. 7 shows a portion of a continuous stator ring 300 having a continuous one-piece outer shroud 302 from which the airfoils extend inward.

The foregoing principles may be applied in the reengineering of an existing engine configuration or in an original engineering process. Various engineering techniques may be utilized. These may include simulations and actual hardware testing. The simulations/testing may be performed at static conditions and one or more non-zero speed conditions. The non-zero speed conditions may include one or both of steady-state operation and transient conditions (e.g., accelerations, decelerations, and combinations thereof). The simulation/tests may be performed iteratively, varying parameters such as spacer thickness, spacer curvature or other shape parameters, vane sweep, dihedral, and bow profiles or vane tip curvature or other shape parameters, and static tip-to-spacer separation (which may include varying specific positions for the tip and the spacer). The results of the reengineering may provide the reengineered configuration with one or more differences relative to the initial/baseline configuration. The baseline configuration may have featured similar spacers or different spacers (e.g., frustoconical spacers). The reengineered configuration may involve one or more of eliminating outboard interdisk cavities, eliminating inboard blade platforms and seals (including elimination of sealing teeth on one or more of the spacers), providing the area rule effect, and the like.

Figure 8:
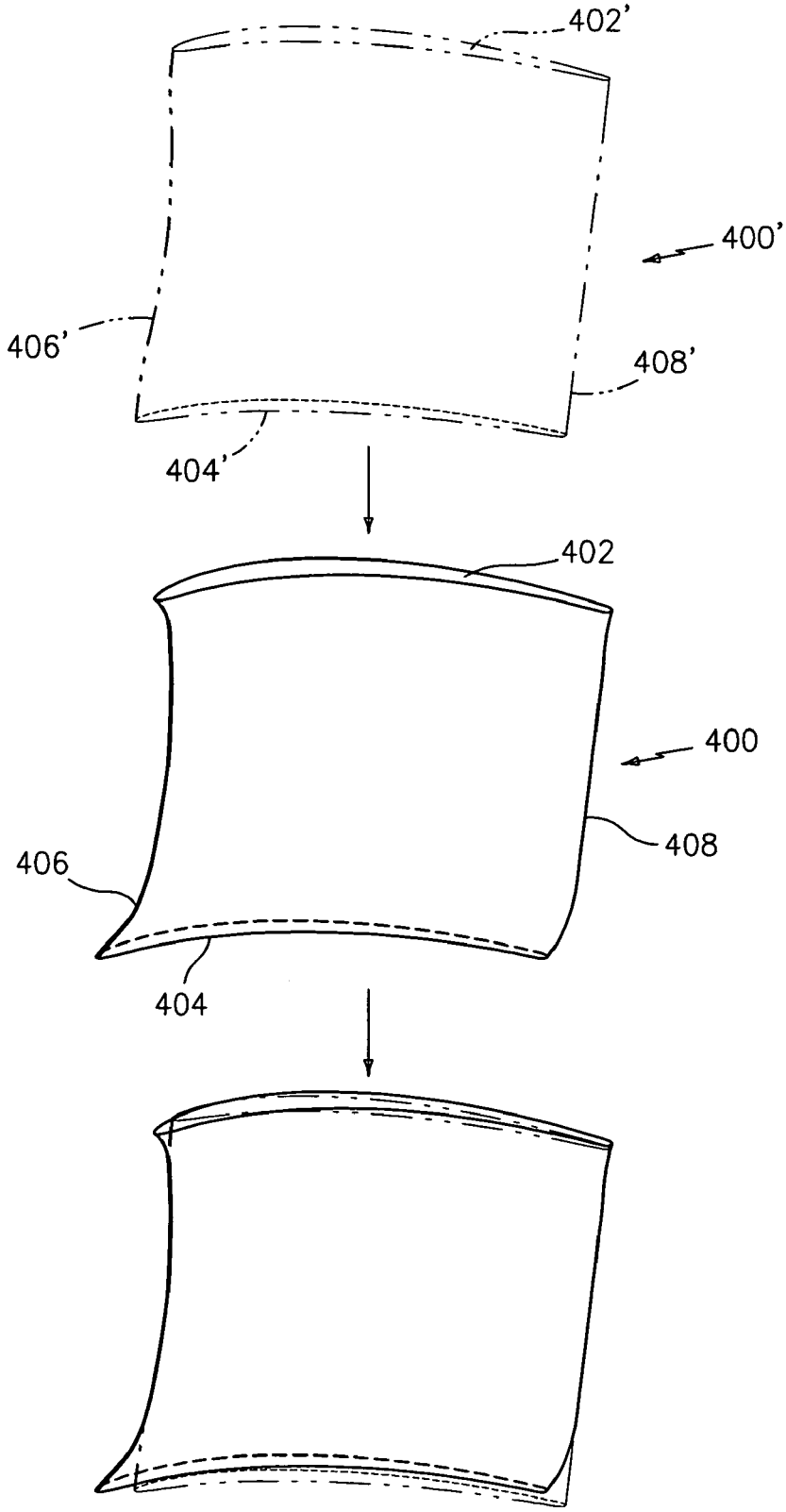
FIG. 8 is an isometric view of a reengineered vane airfoil and a baseline rear airfoil superposed.

For one exemplary reengineering, FIG. 8 shows the superposition of a reengineered vane airfoil 400 and a baseline vane airfoil 400'. The airfoil 400 has an outboard end 402 and an inboard end 404. The airfoil 400' has an outboard end 402' and an inboard end 404'. In an exemplary reengineering, the inboard end 404 is a free end whereas the outboard ends 402 and 402' and inboard end 404' are merely at junctions of the airfoil with the adjacent ID or OD platform or shroud. The airfoils 400 and 400' have respective leading edges 406 and 406' and trailing edges 408 and 408'.

The addition of tip-localized leading edge forward sweep and/or negative dihedral in the reengineered airfoil relative to the baseline airfoil may improve overall performance. Specifically, it may decrease the impact of the tip-to-spacer clearance on performance. Losses may be reduced. The radial distribution of stator vane exit velocity and stagnation pressure may be improved, maintaining higher momentum near the tip region. The effect on axial momentum may be particularly large when the vane stage is throttled toward a stall condition and the angle of incidence to the next downstream blade row is reduced.

Figure 9:
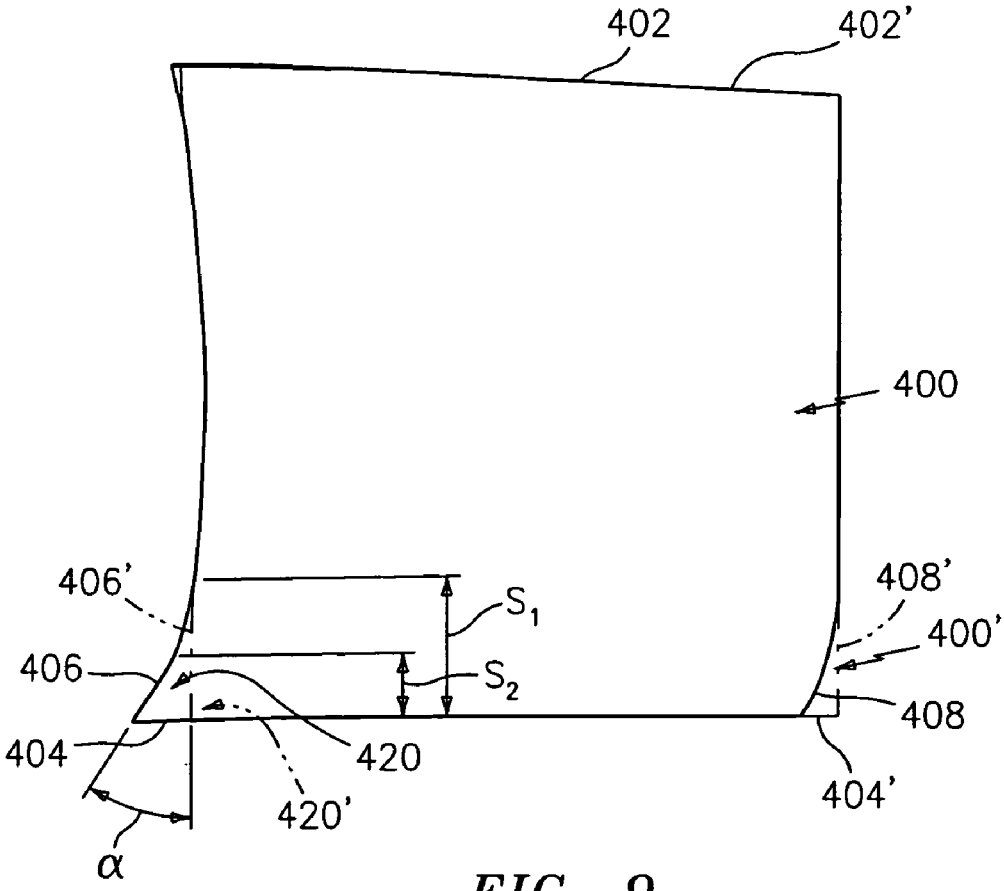
FIG. 9 is a profiled view of the superposed airfoils of FIG. 8.
Figure 10:
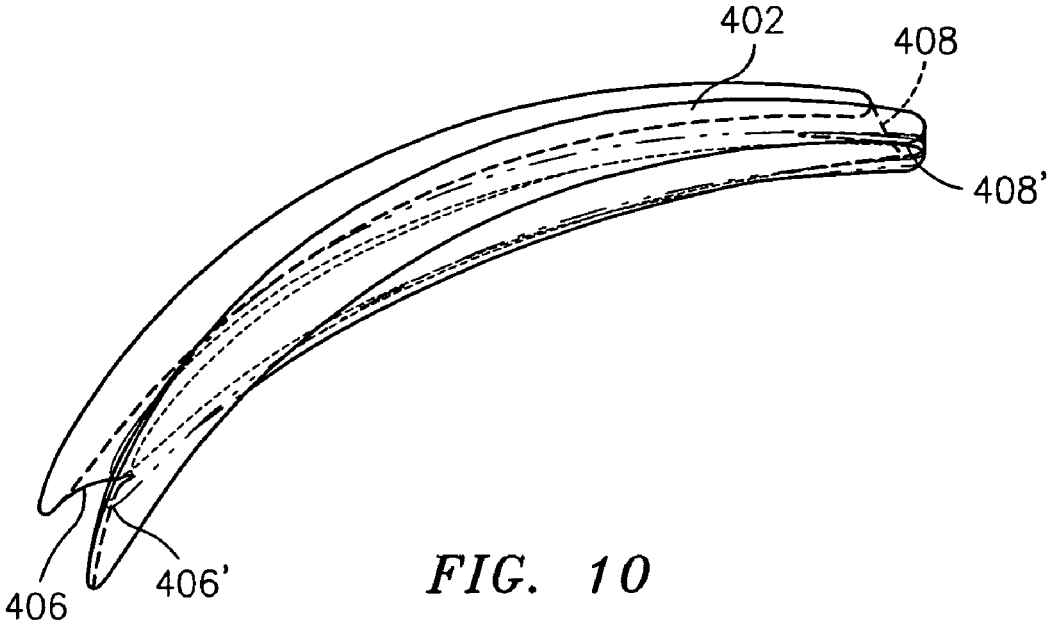
FIG. 10 is a top (radially inward) view of the superposed airfoils of FIG. 8.

FIG. 9 shows a leading edge tip region 420 of the airfoil 400 having a terminal sweep angle α. With the airfoil treated as a spanwise series of stacked airfoil sections, sweep is characterized by displacements of the sections parallel to their chord lines. Thus, the view of FIG. 9 is essentially normal to the chord line at the tip 404. The exemplary baseline airfoil is essentially unswept in the corresponding region 420'. The exemplary regions 420 and 420' depart along a region of radial span $S_1$. The transition to the sweep α may be gradual. In the exemplary reengineering, however, the sweep is essentially α over a span $S_2$. Exemplary $S_1$ is 20-40% of total span and $S_2$ is 10-20% of total span. Exemplary α is 25-45°, more narrowly 30-40°. Along a majority of the remainder of the span, more narrowly, a majority of the total span, the airfoil may extend substantially radially (e.g., within 10°, more narrowly 5° of radial).

Figure 11:
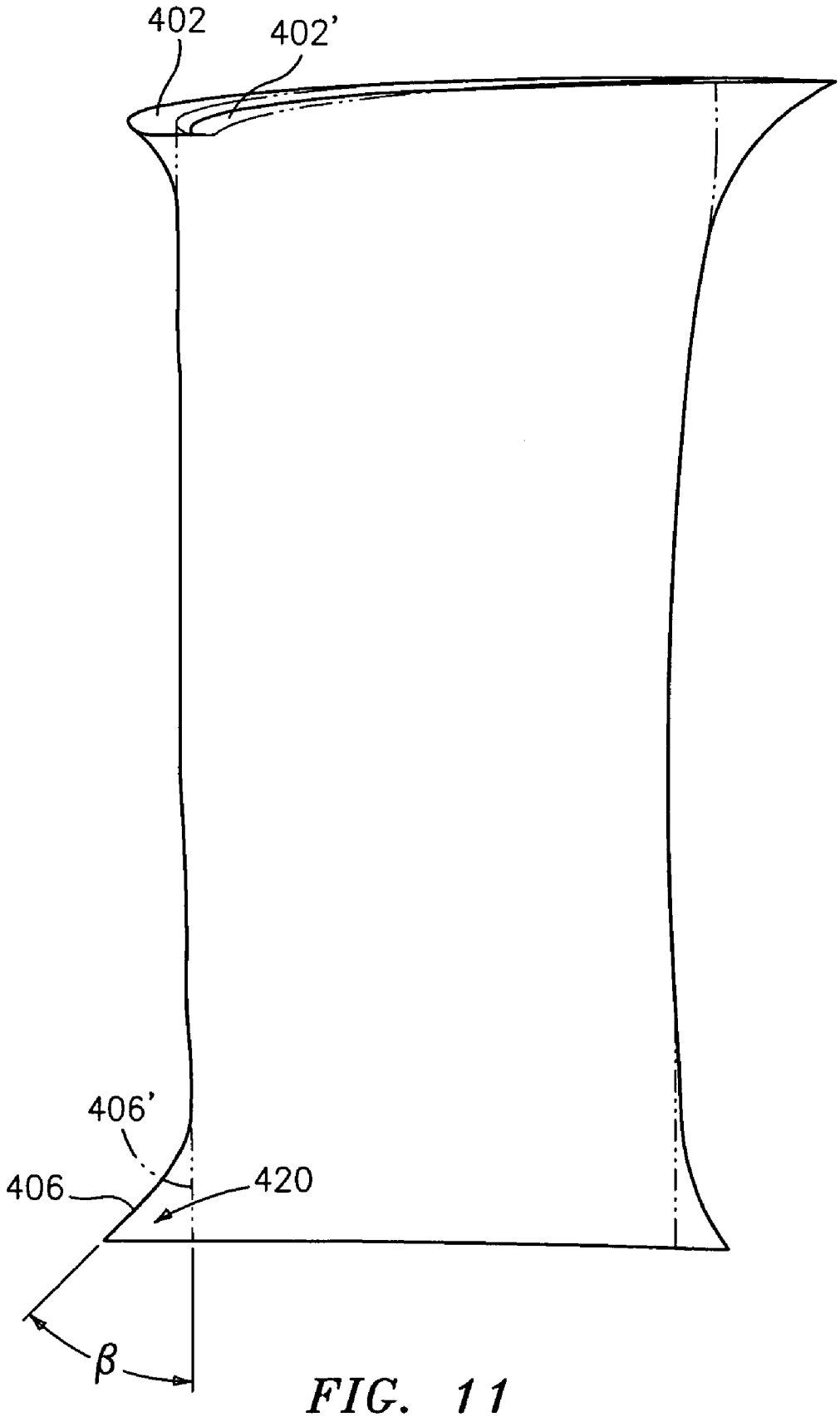
FIG. 11 is a front view of the superposed airfoils of FIG. 8.
Figure 12:
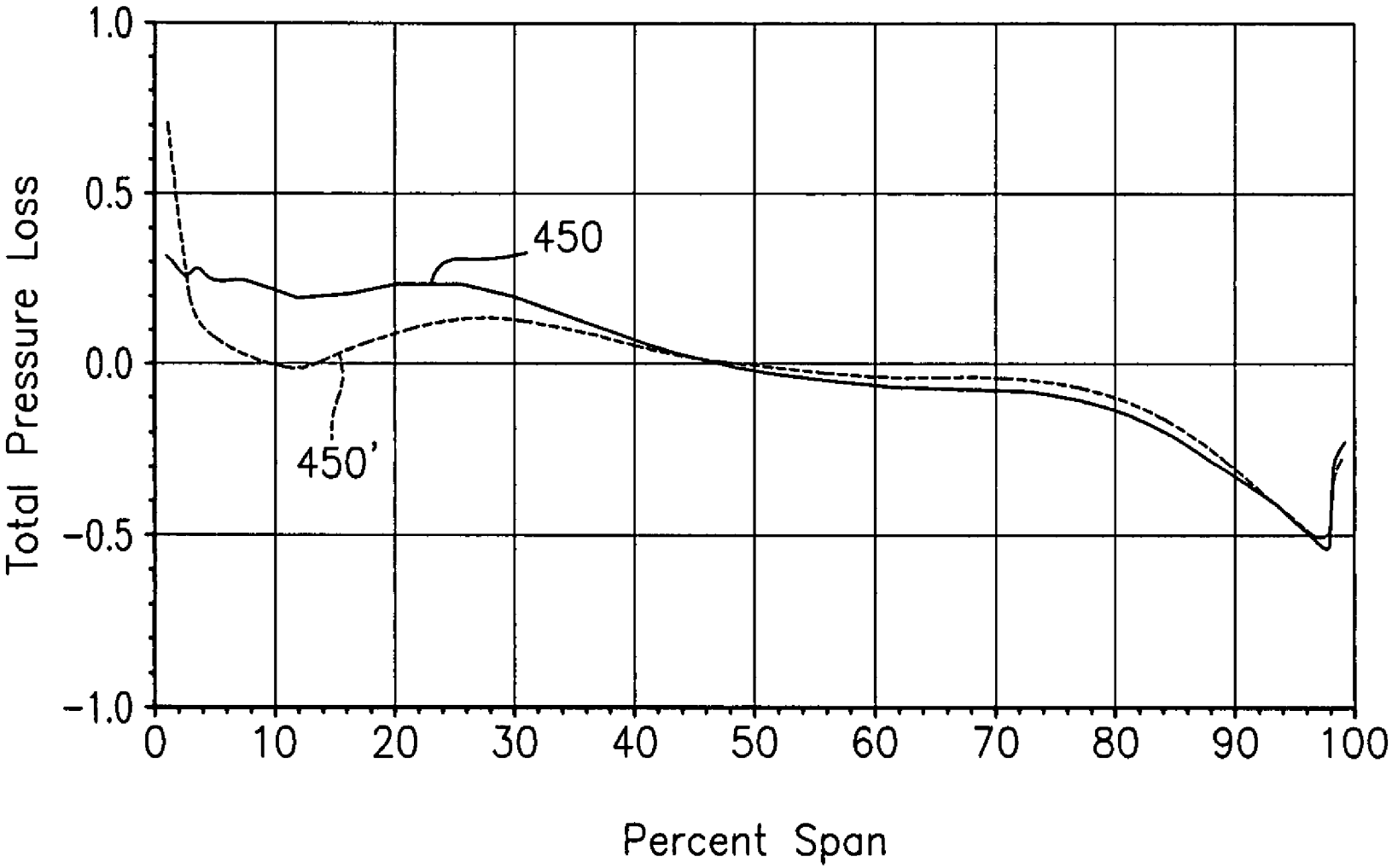
FIG. 12 is a graph of total pressure loss against span for the baseline and reengineered airfoils of FIG. 8.

There may be dihedral departures along the same region 420. FIG. 11 shows a terminal dihedral β. Dihedral is characterized by displacement of the airfoil sections normal to their chord lines. Dihedral may be measured at the center of gravity of the airfoil section or as the intersection of datum parallel to the airfoil stacking line and suction side surface. For reference, positive dihedral decreases the angle between the suction side surface and the adjacent surface (e.g., outer surface of the spacer or outer surface of an adjacent platform). Exemplary β are 30-60°, more narrowly 35-55°. In a computational fluid dynamics (CFD) analysis, the exemplary forward sweep and negative dihedral have the effect of pulling more airflow to the tip region and strengthening the flow profiles at the tip. This reduces turbulent kinetic energy resulting in reduced pressure loss and increased flow. FIG. 12 plots pressure loss 450 of the airfoil 400 and 450' of the airfoil 400'. Significant reduction in loss is observed in a region from approximately 4-30% of span. Below that, there may be a local increase in loss due to increased flow. However, the effect of this local loss increase is offset by the loss decrease elsewhere (e.g., demonstrated when this pressure loss is integrated across the airfoil total span to create a performance/loss parameter). Net leakage flow through the vane clearance gap may also be reduced due to the dihedral increasing non-radial flow.

One or more embodiments of the present invention have been described. Nevertheless, it will be understood that various modifications may be made without departing from the spirit and scope of the invention. For example, when applied as a reengineering of an existing engine configuration, details of the existing configuration may influence details of any particular implementation. Among other factors, the size of the engine will influence the dimensions associated with any implementation relative to such engine. Accordingly, other embodiments are within the scope of the following claims.

What is claimed is:

1. A turbine engine comprising:
a rotor comprising:
a plurality of disks, each disk extending radially from an inner aperture to an outer periphery;
a plurality of stages of blades, each stage borne by an associated one of said disks; and
a plurality of spacers, each spacer between an adjacent pair of said disks; and
a stator comprising a plurality of stages of vanes, the vanes of at least a first of said stages of vanes having airfoils with:
inboard tips in facing proximity to an outer surface of a first of said spacers; and
a dihedral and sweep profile characterized by:
leading edge sweep of 25-45° along a first region of at least 10% of total span starting within 5% of the tip; and
dihedral of 30-60° along a second region of at least 10% of total span staffing within 5% of the tip.

2. The engine of claim 1 wherein:
said dihedral is 35-55° along said second region.

3. The engine of claim 1 wherein:
said leading edge sweep is 30-40° along said first region.

4. The engine of claim 1 wherein:
along a majority of the total span, the airfoil extends within 10° of radial.

5. The engine of claim 1 wherein:
said first region is 20-40% of the total span.

6. The engine of claim 1 wherein:
said first spacer has a longitudinal cross-section, said longitudinal cross-section having a first portion being essentially outwardly concave in a static condition; and
a central shaft carries the plurality of disks and the plurality of spacers to rotate about an axis with the plurality of disks and the plurality of spacers.

7. The engine of claim 1 wherein:
the first stage of vanes is between an upstream-most one and a next one of said plurality of stages of blades.

8. The engine of claim 1 wherein:
the inboard tips of the first stage of vanes are longitudinally convex.

9. The engine of claim 1 wherein:
in a stationary condition, the inboard tips of the first stage of vanes are within 1 cm of an outboard surface of the first spacer along.

10. The engine of claim 1 wherein:
the plurality of disks are high speed compressor section disks.

11. A gas turbine engine stator component comprising:
a shroud or a shroud segment;
at least one airfoil unitarily formed with or secured to the shroud or shroud segment and having:
leading and trailing edges;
pressure and suction sides;
a proximal outboard root;
a distal inboard tip; and
a dihedral and sweep profile characterized by:
leading edge sweep of 25-45° along a first region of at least 10% of total span starting within 5% of the tip; and
dihedral of 30-60° along a second region of at least 10% of total span staffing within 5% of the tip.

12. The stator component of claim 11 wherein:
the shroud or shroud segment and the at least one airfoil are unitarily-formed as a single piece of a metallic material.

13. A turbine engine vane element comprising:
an outboard shroud having outboard and inboard surfaces the inboard surface being concave in a first direction so as to essentially define a longitudinal axis of curvature; and
an airfoil element having:
a root at the shroud inboard surface;
a tip; and
a dihedral and sweep profile characterized by:
leading edge sweep of 25-45° along a first region of at least 10% of total span starting within 5% of the tip; and
dihedral of 30-60° along a second region of at least 10of total span starting within 5% of the tip.

14. The element of claim 13 wherein:
said first region is 20-40% of the total span.

15. A plurality of elements of claim 13 assembled to form a vane stage.

16. For a gas turbine engine configuration comprising:
a rotor stack comprising:
a plurality of disks, each disk extending radially from an inner aperture to an outer blade-bearing periphery; and
a plurality of spacers, each spacer between an adjacent pair of said disks;
a plurality of vane stages interspersed with the disks; and
a shaft carrying the rotor stack,
a method for engineering the engine configuration comprising:
for at least a first of said vane stages varying a dihedral and sweep distribution to a final distribution characterized by:
leading edge sweep of 25-45° along a first region of at least 10% of total span starting within 5% of the tip; and
dihedral of 30-60° along a second region of at least 10 of total span starting within 5% of the tip.

17. The method of claim 16 performed as a simulation.

18. The method of claim 16 wherein the varying achieves a reduction in total pressure loss along a third region of at least 20% of the total span and starting within 10% span from the tip.

19. The method of claim 16 performed as a reengineering of the engine configuration from an initial configuration to a reengineered configuration wherein:
the reengineered configuration provides a reduction in loss relative to the initial configuration.

20. The method of claim 16 performed as a reengineering of an engine configuration from an initial configuration to a reengineered configuration wherein:

the initial configuration has at a dihedral and sweep profile characterized by:

leading edge sweep less than of 20° along a majority of said first region; and dihedral of less than 30° along a said second region.

21. The method of claim 16 performed as a reengineering of an engine configuration from an initial configuration to a reengineered configuration wherein:

relative to the initial configuration the reengineered configuration removes inboard platforms from the vanes of the first vane stage.

22. The method of claim 16 performed as a reengineering of an engine configuration from an initial configuration to a reengineered configuration wherein:

relative to the initial configuration the reengineered configuration provides a reduced average tip-to-rotor gap.

23. A turbine engine comprising:

a rotor comprising:

a plurality of disks, each disk extending radially from an inner aperture to an outer periphery;

a plurality of stages of blades, each stage borne by an associated one of said disks; and a plurality of spacers, each spacer between an adjacent pair of said disks; and a stator comprising a plurality of stages of vanes, the vanes of at least a first of said stages of vanes having airfoils with:

inboard tips in facing proximity to an outer surface of a first of said spacers; and a dihedral and sweep profile characterized by at least one of:

leading edge sweep of 25-45° along a first region of at least 10% of total span starting within 5% of the tip; and dihedral of 30-60° along a second region of at least 10% of total span starting within 5% of the tip, and wherein:

said first spacer has a longitudinal cross-section, said longitudinal cross-section having a first portion being essentially outwardly concave in a static condition; and a central shaft carries the plurality of disks and the plurality of spacers to rotate about an axis with the plurality of disks and the plurality of spacers.

24. A turbine engine comprising:

a rotor comprising:

a plurality of disks, each disk extending radially from an inner aperture to an outer periphery;

a plurality of stages of blades, each stage borne by an associated one of said disks; and a plurality of spacers, each spacer between an adjacent pair of said disks; and a stator comprising a plurality of stages of vanes, the vanes of at least a first of said stages of vanes having airfoils with:

inboard tips in facing proximity to an outer surface of a first of said spacers, the inboard tips being longitudinally convex; and a dihedral and sweep profile characterized by at least one of:

leading edge sweep of 25-45° along a first region of at least 10% of total span starting within 5% of the tip; and dihedral of 30-60° along a second region of at least 10% of total span starting within 5% of the tip.

* * * * *